United States Patent [19]

Schmidt

[11] Patent Number: 5,018,632

[45] Date of Patent: May 28, 1991

[54] TAMPER EVIDENT CLOSURE

[75] Inventor: Frank J. Schmidt, Lisle, Ill.

[73] Assignee: Continental White Cap Inc., Northbrook, Ill.

[21] Appl. No.: 545,718

[22] Filed: Jun. 29, 1990

[51] Int. Cl.[5] ..... B65D 43/00

[52] U.S. Cl. ..... 215/230; 215/250; 220/265

[58] Field of Search ..... 215/203, 230, 250, 262, 215/270, 276; 220/214, 265

[56] References Cited

U.S. PATENT DOCUMENTS

| | | | |
|---|---|---|---|
| 4,502,605 | 3/1985 | Wloszezyna | 215/230 |
| 4,576,297 | 3/1986 | Larson | 215/250 |
| 4,747,500 | 5/1988 | Gach et al. | 215/250 |
| 4,793,500 | 12/1988 | Harding | 215/230 |

*Primary Examiner*—Stephen P. Garbe
*Assistant Examiner*—Nova Stucker
*Attorney, Agent, or Firm*—Lockwood, Alex, FitzGibbon & Cummings

[57] ABSTRACT

This relates to a tamper indicating closure which includes a closure cap having a button which is movable between an elevated position and a downwardly recessed position in accordance with the state of closure of an associated container. In particular, the button is provided with a tamper indicating arrangement which will include a first layer directly attached to the button and an overlying second layer which is connected to the button generally at the periphery thereof. The first layer is in the form of a photoactive layer and the second layer is in the form of a friable filter material. Normally the second layer protects the first layer, but when the button changes its shape, the friable filter layer will crack and expose the underlying photoactive layer to cause a change in the photoactive layer. This change could be in the form of the disappearance of a message, including a UPC code or the developing of a previously formed message on the photoactive layer so as to make that message appear.

15 Claims, 1 Drawing Sheet

TAMPER EVIDENT CLOSURE

This invention relates in general to new and useful improvements in closures, and more specifically to a closure which has positive means for indicating that an associated container has been opened by at least partially removing the closure.

It is known to provide a tamper indicating closure having a central button which, when a product is vacuum packed, will result in a vacuum within the container drawing the button down with the button moving back to its original position when the vacuum within the container is released. This prior button arrangement has certain deficiencies. First of all, the button per se, is not necessarily noticable by a purchaser or a user of a product. Next, it is feasible to open a vacuum packed container, tamper with the product packaged therein, and again produce a vacuum within the container sufficient to again draw the button down and thereby eliminate all evidence of the prior opening of the container.

In accordance with this invention, it is proposed to provide in overlying relation to the button a tamper indicating arrangement which is not reversible. Most particularly, in accordance with this invention, the button is provided with a light sensitive paper or film which has a restricted spectral response and which paper or film is covered with a friable blocking filter. When the button of the closure cap reverses its position due to opening of an associated container, the friable filter will be ruptured or released from the closure cap so as to permit light to be received by the light sensitive paper or film and selectively provide a message or eliminate a message. In both arrangements, the net result will be an arrangement which will attract a user's attention and indicate the prior opening of the container. Further, and most specifically, the tamper indicating arrangement is not reversible by reapplying the closure cap nor is the tamper indicating arrangement repairable.

With the above and other objects in view that will hereinafter appear, the nature of the invention will be more clearly understood by reference to the following detailed description, the appended claims, and the several views illustrated in the accompanying drawings.

Figure 1:
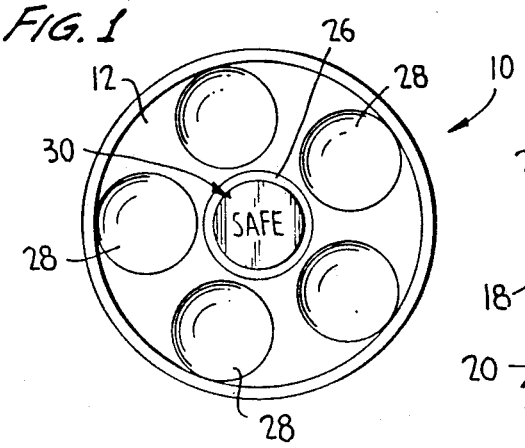
FIG. 1 is a top plan view of a typical closure cap with a mechanically actuated button utilizing the tamper indicating device which is the subject of this invention.
Figure 2:
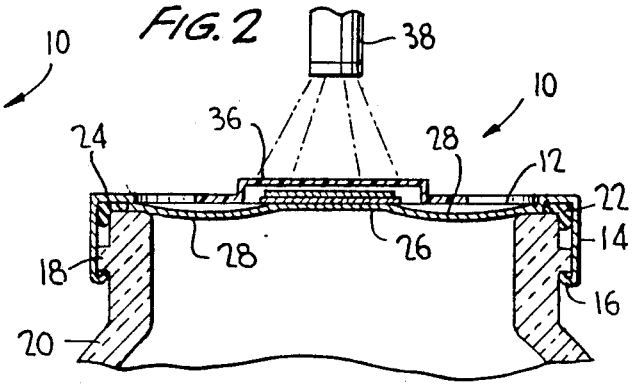
FIG. 2 is a fragmentary transverse vertical sectional view taken through the closure cap of FIG. 1 and shows the same applied to a container.
Figure 3:
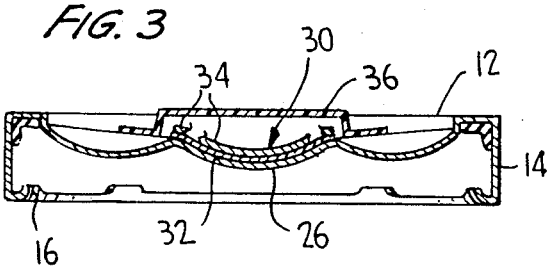
FIG. 3 is a transverse vertical sectional view similar to FIG. 2 and shows the closure cap as it would appear when released or at least partially released from a container.
Figure 5:
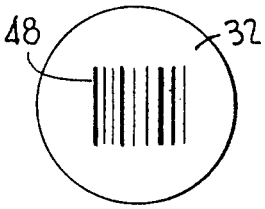
FIG. 5 is a schematic plan view of the tamper indicating layer and shows applied thereto UPC code which is erasable.

Referring now to the drawings in detail, reference is first made to FIGS. 1–3 wherein there is illustrated a recently developed closure cap generally identified by the numeral 10. The closure cap 10 per se is not part of this invention, but constitutes a vehicle for carrying and actuating the tamper indicating device which is the subject of this invention. The closure cap 10 is preferably formed of metal and includes an end panel 12 carrying a depending skirt 14. Preferably, the skirt 14 terminates in a plurality of locking flanges 16 which are engagable with lugs 18 carried by a container 20. A suitable ring of sealing compound 22 is disposed in a corner between the end panel 12 and the skirt 14 and is engagable with an end sealing surface 24 of the container 20 when the closure cap 10 is applied to the container 10 and sealed thereto by locking the flanges 16 below the lugs 18.

The end panel 12 is provided with a centrally located mechanically actuated button 26. In order that the button 26 may be actuated, the end panel 12 is provided with a plurality of downwardly projecting button-like depressions 28. The button-like depressions 28 are engagable with the end sealing surface 24 of the container 20 when the closure cap 10 is applied and are caused to deflect in a manner wherein the central button 26 changes shape from its concave shape of FIG. 3 to its generally flat upwardly projecting shape of FIG. 2.

At this time it is to be understood that when the closure cap 10 is removed from the container 20, the button 26 will automatically deform from its generally upwardly projecting shape of FIG. 2 to its recessed concave shape of FIG. 3. Therefore, the button 26 per se will not indicate that a container has been opened and then reclosed merely because the applied shape of the closure cap button 26 will return when the closure cap is reapplied.

In accordance with this invention, there is carried by the upper surface of the button 26 a tamper indicating unit generally identified by the numeral 30. The tamper indicating unit 30 includes a first layer 32 which is suitably adhesively secured to the upper surface of the button 26. A second layer 34 overlies the first layer 32 and protects the same in a manner to be described hereinafter.

A suitable transparent overcap 36 may be secured to the cap outside of the button 26 so as to protect the layers 32, 34.

At this time it is pointed out that the first layer 32 will be formed of a material which can flex with the button 26 and thus remains intact when the shape of the button 26 changes from that of FIG. 2 to that of FIG. 3. On the other hand, the second material 34 is preferably formed of a friable material which, when the button 26 changes shape from the first shape of FIG. 2 to the second shape of FIG. 3 will disengage from the closure cap 10 by rupturing or will crumble so that the first layer 32 will become exposed.

At this time it is pointed out that the first layer 32 is preferably in the form of a light sensitive paper or film which has a restricted spectral response. On the other hand, the second layer 34 is in the form of a friable blocking filter.

Referring once again to FIGS. 2 and 3, it will be seen that the layer 34 normally overlies and protects the layer 32. However, when the button 26 changes in shape from that of FIG. 2 to that of FIG. 3, the layer 34 will automatically rupture so as to crumble or to tear loose from the end panel 12 thereby exposing light sensitive paper or film of the layer 32.

Consideration is given to how the tamper indicating unit 30 is applied. In one embodiment of the invention, the tamper indicating unit 30 is applied to the button 26 while the button 26 is in its concave shape of FIG. 3. However, at this time the second layer 34 is not friable and is free to deflect with the button 26. Thus when the closure cap 10 is applied to the container 20 in the manner illustrated in FIG. 2, there is no deterioration of the second layer 34. Further, if no change were made in the tamper indicating unit 30 at this time, and the closure cap 10 were removed from the container 20, the button 26 would merely deflect back to its original shape of FIG. 3 and there would be no rupture of the second layer 34. Therefore, after the closure cap 10 has been applied to a filled container 20, the second layer 34 is treated, such as by application of certain heat to the second layer 34 or by UV radiation. A suitable flexible photoresist may serve as the blocking filter of the layer 34. The treatment of the then flexible second layer 34 by a selective heat or UV source 38 is schematically illustrated in FIG. 2.

Figure 4:
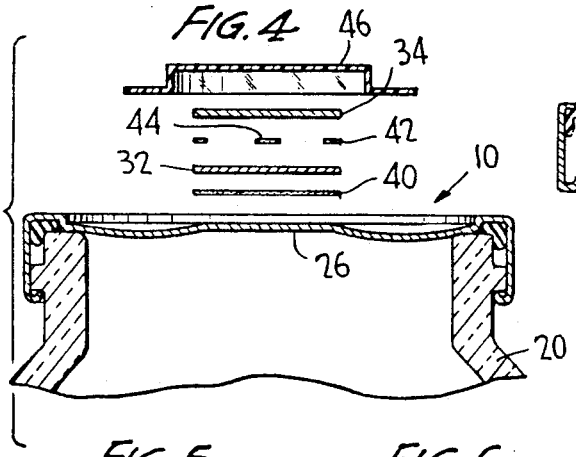
FIG. 4 is another fragmentary vertical sectional view similar to FIG. 2 and shows a method of applying the tamper indicating device.

On the other hand, the tamper indicating unit 30 may be applied to the closure cap 10 after it is applied to close the container 20 as is best shown in FIG. 4. After the container 20 has been sealed by the closure cap 10 and the button 26 of the closure cap moved to the shape shown in both FIG. 2 and FIG. 4, the packer would then apply the tamper indicating unit 30 to the generally flattened button 26. The first layer 32 will be bonded to the button 26 outer surface utilizing an adhesive layer 40 followed by the application of the second layer 34 preferably utilizing an adhesive ring 42 about its periphery and a central adhesive part 44. Thereafter, the transparent cover 46 is applied.

When the tamper indicating unit 30 is applied while the button 26 is in its mechanically actuated shape of FIG. 4, it is feasible that the second layer 34 be in its friable state although it may be flexible at the time of application and the second layer 34 will be treated after the tamper indicating unit 30 has been applied as shown in FIG. 1.

The layers 32, 34 may take different forms. The friable filter of layer 34 could be complementary in color with respect to the spectral response of the photoactive layer 32 and block all UV invisible light at those wavelengths that would expose and/change the light sensitive layer. The friable filter would, however, be transparent at all other wavelengths thereby enabling the consumer to view through the filter layer 34 a message, symbol, etc. or absence thereof This would allow the consumer to ascertain the integrity of the package or container prior to purchase.

For example, the layer 32 may have formed on the upper surface thereof as part of the photo sensitive characteristics thereof a UPC code 48 that will be visible through the second layer 34. As long as the UPC code 48 is visible, the package will be in a saleable condition. However, if the tamper indicating unit 30 is actuated by a removal or part removal of the closure cap from the container 20, the friable filter layer 34 will be ruptured and the light sensitive surface of the first layer 32 will be exposed with the result that the UPC code 48 would disappear.

Figure 6:
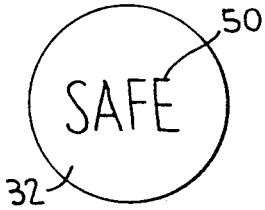
FIG. 6 is another view of the tamper indicating layer with a message thereon.

In FIG. 6 there is illustrated a slightly modified form of first layer 32 wherein in lieu of the UPC code 48 being initially visible on the surface of the first layer 32, the word "SAFE" or a similar word 50 will be formed and will be normally visible. However, when the cap 10 is moved to an open position and the friable layer 34 ruptures, the word "SAFE" will disappear.

Figure 7:
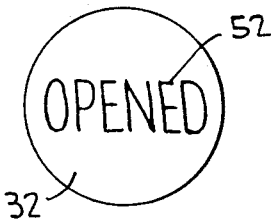
FIG. 7 is a plan view of yet another tamper indicating layer having a message thereon which is not visible until the layer is exposed.
Figure 8:
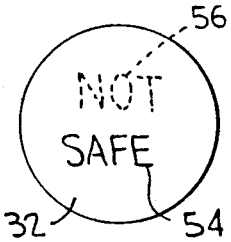
FIG. 8 is yet another plan view of a tamper indicating layer which has a part permanent message and a part developable message.

On the other hand, the characteristics of the light sensitive paper or film forming the first layer 32 may be such that areas thereof may be pre-treated so that when exposed, would be developed and a preformed message would appear. For example, as shown in FIG. 7, a message 52 in the form of the word "OPENED" may be prior exposed but is not visible. However, when the friable second layer 34 is ruptured, and the photo sensitive surface of the first layer 32 becomes exposed, the marking on the first layer 32 will be developed and the word "OPENED" will appear.

It is also possible to provide the photo sensitive paper or film of the first layer 32 with a dual part message. For example, the word "SAFE" identified by the numeral 54, may be permanently printed or developed on the surface of the layer 32. Adjacent the word "SAFE" will be the previously exposed word "NOT" identified by the reference numeral 56. In the initial state of the closed container, the word "NOT" will not be visible and thus the closure cap 10 will indicate that the package is safe. However, when the closure cap is at least partially removed from the container, the word "NOT" will appear to indicate that the package is "NOT SAFE".

It is to be understood that many different types of messages may be developed. Further, it is to be understood that while at the present the invention proposes to utilize a commercially available photographic paper or film the invention is not restricted to existing papers and films.

Figure 9:
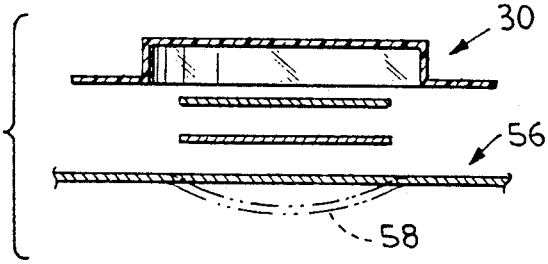
FIG. 9 is a fragmentary exploded vertical sectional view similar to FIG. 4 but in relation to a closure cap having a vacuum indicating button.

It is also understood that while the preferred carrier for the tamper indicating unit 30 is the mechanically actuated button 26 of the closure cap 10, it is also possible that the tamper indicating unit 30 could be applied to a prior art closure cap 56 of the type which includes a vacuum actuated button 58 as is shown in FIG. 9.

A particular advantage of the invention is that by utilizing the friable blocking filter to break, crack and/or part exposing the underlying photoactive layer 32, an irreversible change is made in the photoactive layer 32. Thus, for example, if the closure cap 10 is loosened relative to the container 20 and then re-tightened thereon, the evidence of tampering will not be reversed.

Further, it is to be understood that while no specific friable layer, except for a photoresist, has been specifically disclosed here, it is to be understood that the composition of the friable layer 34 must be such that it cannot be readily replaced or repaired. If the friable layer is repairable such as with heat, for example, the exponential development of the photoactive layer with respect to temperature would accelerate the destruction of the photoactive layer defeating an attempt to tamper. The same is also true should an attempt be made to remove the friable layer 34 and replace it with a new layer and that all efforts to completely remove the friable layer as necessary would destroy the photoactive layer 32.

Although only several preferred embodiments of the invention have been specifically illustrated and described herein, it is to be understood that minor variations may be made in the tamper indicating unit and the appliction thereof to a closure cap without departing from the spirit and scope of the invention as defined by the appended claims.

I claim:

1. A tamper indicating closure comprising a cap having a deflectable button which assumes a first shape when said cap is in a container closing position and a . second shape when said cap is released relative to a container, a first layer applied to an exterior of said button, said first layer being sensitive to external conditions, a second layer overlying said first layer, said second layer being in the form of a blocking material protecting said first layer from external conditions when said cap button has said first shape, said second layer being formed of a friable material and so bonded to said cap whereby when said button moves to said second shape said second layer ceases to protect said first layer.

2. A tamper indicating closure according to claim 1 wherein said layers are encased in a transparent enclosure carried by said cap.

3. A tamper indicating closure according to claim 1 wherein said friable material is constructed to rupture beyond repair when said button moves to said second shape.

4. A tamper indicating closure according to claim 1 wherein said first layer is a light sensitive layer and said second layer is a light filter for said light sensitive layer.

5. A tamper indicating closure according to claim 4 wherein said first layer is optically visible through said second layer.

6. A tamper indicating closure according to claim 4 wherein said first layer is optically visible through said second layer, and said first layer displays an initial message.

7. A tamper indicating closure according to claim 4 wherein said first layer is optically visible through said second layer, and said first layer displays an initial message which disappears when said button moves to said second shape and said second layer ruptures.

8. A tamper indicating closure according to claim 4 wherein said first layer is optically visible through said second layer, and said first layer displays an initial message in the form of a UPC code, whereby a container with said closure thereon will not code readable when prior opened.

9. A tamper indicating closure according to claim 4 wherein said first layer is sensitive to only a limited band of wavelengths.

10. A tamper indicating closure according to claim 4 wherein said first layer has a restricted spectral response, and said second layer is complementary in color with respect to said spectral response.

11. A tamper indicating closure according to claim 4 wherein said first layer has a message thereon initially invisible and developable when said second layer is ruptured.

12. A tamper indicating closure according to claim 11 wherein said first layer is photographic paper which is self activating when exposed.

13. A tamper indicating closure according to claim 1 wherein said second layer is cured after said button assumes said first shape as to be friable.

14. A tamper indicating closure according to claim 1 wherein said second layer is cured after said button assumes said first shape to be friable and is applied to said button together with said first layer when said button is in said first shape.

15. A tamper indicating closure according to claim 1 wherein said second layer is cured after said button assumes said first shape to be friable and is applied to said button together with said first layer after said closure cap is applied to close a container and said button is in said first position.

* * * * *